US011498181B2

(12) United States Patent
Wang

(10) Patent No.: US 11,498,181 B2
(45) Date of Patent: Nov. 15, 2022

(54) POLISHING PAD AND MANUFACTURING METHOD OF POLISHING PAD AND POLISHING METHOD

(71) Applicant: IV Technologies CO., Ltd., Taichung (TW)

(72) Inventor: Yu-Piao Wang, Hsinchu County (TW)

(73) Assignee: IV Technologies CO., Ltd., Taichung (TW)

( * ) Notice: Subject to any disclaimer, the term of this patent is extended or adjusted under 35 U.S.C. 154(b) by 922 days.

(21) Appl. No.: 16/109,675

(22) Filed: Aug. 22, 2018

(65) Prior Publication Data

US 2019/0061096 A1 Feb. 28, 2019

(30) Foreign Application Priority Data

Aug. 22, 2017 (TW) ..... 106128497

(51) Int. Cl.
*B24B 37/20* (2012.01)
*B24B 49/12* (2006.01)
*B24B 37/013* (2012.01)

(52) U.S. Cl.
CPC ..... *B24B 37/205* (2013.01); *B24B 37/013* (2013.01); *B24B 49/12* (2013.01)

(58) Field of Classification Search
CPC ..... B24B 37/205; B24B 37/013; B24B 49/12; B24B 37/22; B24B 37/20
See application file for complete search history.

(56) References Cited

U.S. PATENT DOCUMENTS

| | | | | |
|---|---|---|---|---|
| 5,893,796 | A | 4/1999 | Birang et al. | |
| 7,204,742 | B2 * | 4/2007 | Prasad | B24B 37/20 451/41 |
| 7,323,415 | B2 * | 1/2008 | Shiho | B24B 37/205 438/691 |
| 8,609,001 | B2 * | 12/2013 | Pai | B24B 37/24 264/255 |
| 9,227,294 | B2 * | 1/2016 | Cheng | B24B 49/10 |
| 9,259,820 | B2 * | 2/2016 | Qian | H01F 41/00 |
| 9,868,185 | B2 * | 1/2018 | Lefevre | B24B 37/22 |
| 10,239,182 | B2 * | 3/2019 | Jian | B24B 37/013 |
| 11,154,959 | B2 * | 10/2021 | Lehuu | B24B 37/22 |

(Continued)

FOREIGN PATENT DOCUMENTS

| | | |
|---|---|---|
| CN | 1506211 | 6/2004 |
| CN | 102133734 | 7/2011 |

(Continued)

OTHER PUBLICATIONS

"Office Action of China Counterpart Application", dated May 7, 2020, p. 1-p. 5.

*Primary Examiner* — Joel D Crandall
*Assistant Examiner* — Robert F Neibaur
(74) *Attorney, Agent, or Firm* — JCIPRNET

(57) ABSTRACT

A polishing pad including a polishing layer and at least one detection window is provided. The polishing layer includes a polishing surface and a back surface having at least one protrusion. The at least one detection window is disposed at a location corresponding to the at least one protrusion in the polishing layer, and the at least one protrusion surrounds the at least one detection window. A manufacturing method and a polishing method of the polishing pad are also provided.

23 Claims, 10 Drawing Sheets

(56) References Cited

U.S. PATENT DOCUMENTS

| | | | | |
|---|---|---|---|---|
| 2005/0245171 | A1* | 11/2005 | Hosaka | B24D 18/0009 451/6 |
| 2011/0183579 | A1* | 7/2011 | Newelll | B24B 37/26 451/28 |

FOREIGN PATENT DOCUMENTS

| | | |
|---|---|---|
| JP | S5961181 | 4/1984 |
| TW | 201143969 | 12/2011 |

* cited by examiner

POLISHING PAD AND MANUFACTURING METHOD OF POLISHING PAD AND POLISHING METHOD

CROSS-REFERENCE TO RELATED APPLICATION

This application claims the priority benefit of Taiwan application serial no. 106128497, filed on Aug. 22, 2017. The entirety of the above-mentioned patent application is hereby incorporated by reference herein and made a part of this specification.

BACKGROUND OF THE INVENTION

Field of the Invention

The invention relates to a polishing pad and a manufacturing method of the polishing pad and a polishing method, and more particularly, to a polishing pad having a detection window, a manufacturing method of the polishing pad, and a polishing method using the polishing pad.

Description of Related Art

With the advancement of industries, a planarizing process is often adopted for manufacturing various devices. In the planarizing process, a polishing process is often used in the industry. The polishing process includes applying a pressure to press a polished object on a polishing pad, and a polishing slurry (such as water or a mixture of chemicals) is provided between the polished object and the polishing pad, and a relative motion is applied between the polished object and the polishing pad such that the surface of the polished object is gradually flattened to achieve the goal of planarization.

For a polishing equipment having an optical detection system, a transparent detection window is generally disposed in a certain region of the polishing pad, and the polishing situation of the polished object surface layer can be detected through the transparent detection window. For instance, a conventional polishing pad, used in a polishing equipment having an optical detection system (such as FIG. 3F of U.S. Pat. No. 5,893,796), has an aperture including sections with different dimensions, and a detection window is fixed via an adhesive material between the upper surface rim of the detection window and the rim of smaller section in the aperture. However, under the stress in the polishing process, adhesion is often deteriorated such that the polishing slurry leaks, thus affecting the accuracy of the optical detection system. FIG. 1 shows another conventional polishing pad 1 (such as FIG. 3C of U.S. Pat. No. 5,893,796), the detection window 3 thereof is formed in the polishing layer 2, the detection window 3 is coplanar with the polishing surface and the back surface of the polishing layer 2, and the base layer 4 is located below the polishing layer 2 in the region outside the detection window 3. In particular, the detection window 3 has the same thickness as the polishing layer 2. Compared with the detection window adhered around the rim, the detection window 3 of the polishing pad 1 has improved stress tolerance for the polishing process, but it is still not enough to meet the requirements of the industry.

As the polishing pad is used to polish more polished objects, the wear amount of the polishing pad increases, and the bonding area between the detection window and the polishing layer becomes smaller. The interface between the detection window and the polishing layer cannot bear the stress of the polishing process, and the problem of the polishing slurry leakage caused by insufficient bonding strength of the interface still exists, which affects the lifetime of the polishing pad. Therefore, how to increase the bonding strength between the detection window and the polishing layer such that the polishing pad has a good lifetime is an important object for those skilled in the art.

SUMMARY OF THE INVENTION

The invention provides a polishing pad and a manufacturing method thereof, and a detection window thereof has better bonding strength in a polishing layer.

An embodiment of the invention provides a polishing pad including a polishing layer and at least one detection window. The polishing layer has a polishing surface and a back surface having at least one protrusion. The at least one detection window is disposed at a location corresponding to the at least one protrusion in the polishing layer, and the at least one protrusion surrounds the at least one detection window.

An embodiment of the invention provides a manufacturing method of a polishing pad including the following steps. At least one detection window is formed in a polishing material layer. A portion of the polishing material layer is removed to form a polishing layer, wherein the polishing layer includes a polishing surface and a back surface having at least one protrusion, the detection window is disposed at a location corresponding to the at least one protrusion in the polishing layer, and the at least one protrusion surrounds the at least one detection window.

An embodiment of the invention further provides a manufacturing method of a polishing pad including the following steps. A mold having a mold cavity is provided, wherein the mold cavity includes at least one recessed portion, at least one detection window is disposed at a location corresponding to the at least one recessed portion in the mold cavity, and the at least one recessed portion surrounds the at least one detection window. The polishing material layer is disposed in the mold cavity to form a polishing layer, wherein the polishing layer includes a polishing surface and a back surface having at least one protrusion, the at least one detection window is disposed at a location corresponding to the at least one protrusion in the polishing layer, and the at least one protrusion surrounds the at least one detection window. The mold is removed.

Based on the above, in the polishing pad and the manufacturing method thereof provided in the embodiments of the invention, since the detection window is disposed at a location corresponding to the protrusion in the polishing layer and the protrusion surrounds the detection window, the bonding area between the detection window and the polishing layer can be increased such that the bonding strength of the detection window in the polishing layer is better and the lifetime of the polishing pad is increased as a result.

In order to make the aforementioned features and advantages of the disclosure more comprehensible, embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
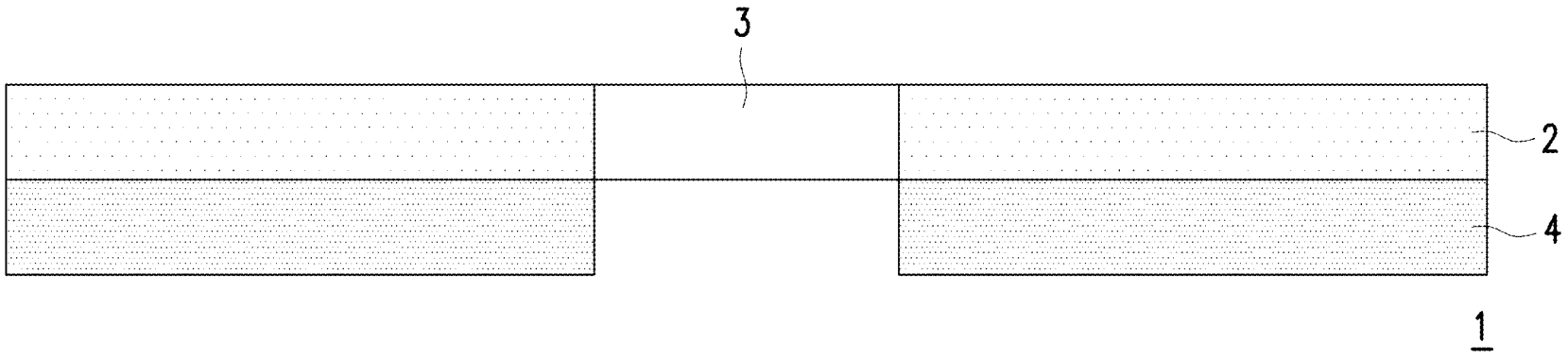
FIG. 1 is a cross section of a known polishing pad.

The above and other technical content, features, and efficacies of the invention are illustrated in the following via the detailed description of a preferred embodiment of the reference figures. Terms used to describe direction in the following embodiments such as up, down, left, right, front, and back are only the directions of the reference figures. Thus, terms used to describe direction are descriptive and are not intended to limit the scope of the invention.

Moreover, the invention is more comprehensively described with reference to the figures of the present embodiments. However, the invention can also be implemented in various different forms, and is not limited to the embodiments in the present specification. The thicknesses of the layers and regions in the figures are enlarged for clarity. The same or similar reference numerals represent the same or similar elements and are not repeated in the following paragraphs.

Figure 2A:
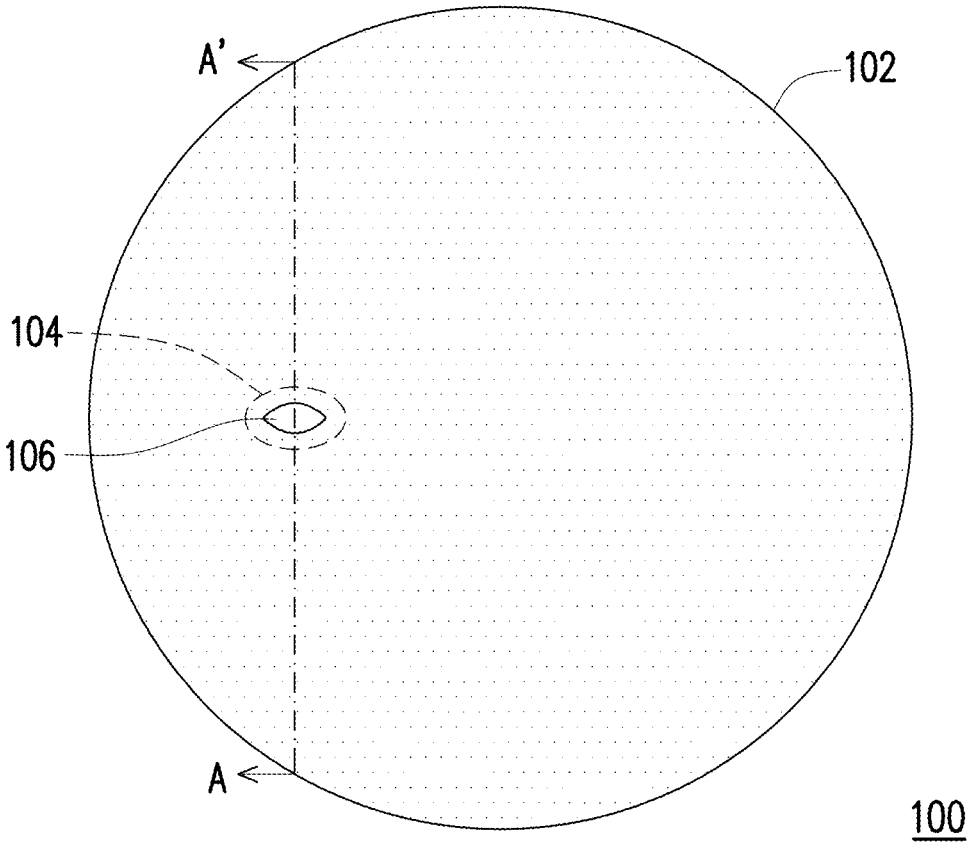
FIG. 2A is a top view of a polishing pad according to an embodiment of the invention.
Figure 2B:
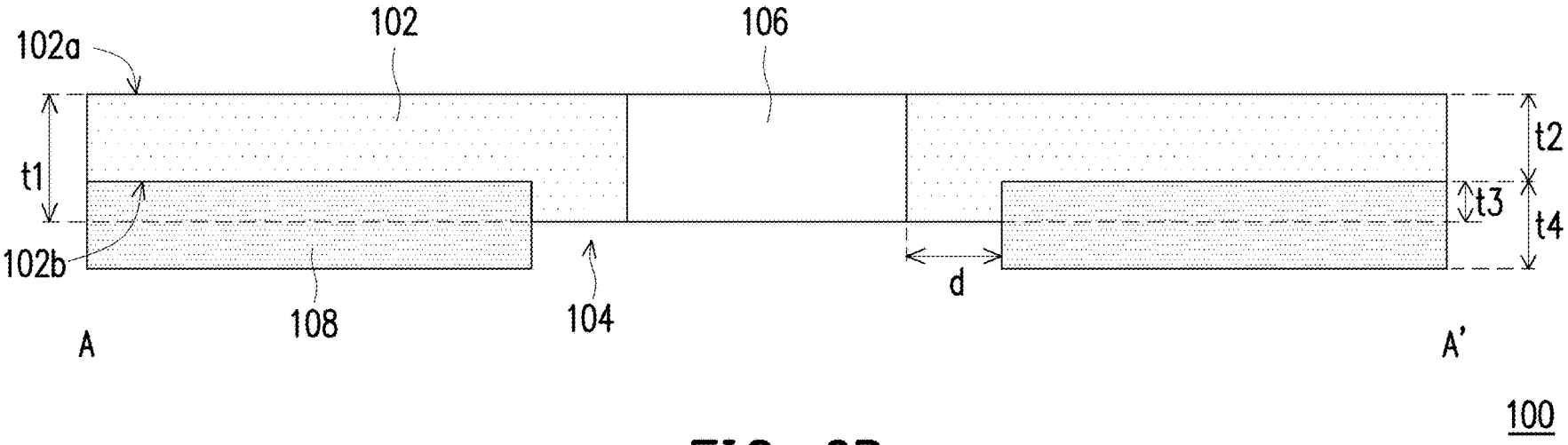
FIG. 2B is a cross section along line A-A' of FIG. 2A.

FIG. 2A is a top view of a polishing pad according to an embodiment of the invention. FIG. 2B is a cross section along line A-A' of FIG. 2A.

Referring to both FIG. 2A and FIG. 2B, a polishing pad 100 includes a polishing layer 102 and at least one detection window 106. The polishing layer 102 includes a polishing surface 102*a* and a back surface 102*b* having at least one protrusion 104, wherein the polishing surface 102*a* is opposite to the back surface 102*b*. The at least one protrusion 104 protrudes from the back surface 102*b* toward a direction away from the polishing surface 102*a* as shown in FIG. 2B. In other words, the polishing layer 102 has the at least one protrusion 104 protruding from the back surface 102*b*. The polishing layer 102 can be formed by a polymer base material. For instance, the polymer base material can be polyester, polyether, polyurethane, polycarbonate, polyacrylate, polybutadiene, other polymer base materials formed by synthesizing a suitable thermosetting resin or thermoplastic resin, or a combination thereof. In an embodiment, in addition to the polymer base material above, the polishing layer 102 can further contain a conductive material, abrasive particle, micro-sphere, or dissolvable additive in the polymer base material. Moreover, the protrusion 104 can be designed as various shapes according to actual requirement, such as rectangle, spindle, or elliptical, but the invention is not limited thereto. The material of the detection window 106 can be a transparent polymer such as thermosetting plastic, thermoplastic, or any currently known material that can be used in the detection window of a polishing pad.

The detection window 106 is disposed at a location corresponding to the protrusion 104 in the polishing layer 102. The polishing layer 102 and a side surface of the detection window 106 are integrally bonded to each other. In other words, the detection window 106 is disposed through the protrusion 104 of the polishing layer 102, and the protrusion 104 surrounds the detection window 106. The thickness corresponding to the region outside the protrusion 104 (i.e., the main polishing region) in the polishing layer 102 is t2, the thickness of the protrusion 104 protruding from the back surface 102*b* of the main polishing region of the polishing layer 102 is t3, the thickness of the detection window 106 is t1, and t1>t2. In an embodiment, the top surface of the detection window 106 and the polishing surface 102*a* of the polishing layer 102 are coplanar, and a bottom surface of the detection window 106 and a bottom surface of the protrusion 104 are coplanar, and therefore the thickness t1 of the detection window 106 is equal to the sum of the thickness t2 corresponding to the region outside the protrusion 104 in the polishing layer 102 and the thickness t3 of the protrusion 104 thereof (i.e., t1=t2+t3). Since the bonding area is positively proportional to the interface thickness between the polishing layer 102 and the detection window 106, in addition to the area corresponding to the portion above the protrusion 104 in the polishing layer 102 (i.e., the area corresponding to the thickness t2 portion), the bonding area between the detection window 106 and the polishing layer 102 further includes the area of the bonding portion with protrusion 104 in the polishing layer 102 (i.e., the area corresponding to the thickness t3 portion). As a result, the bonding area between the detection window 106 and the polishing layer 102 can be increased. Moreover, since the bonding strength is positively proportional to the bonding area between the detection window 106 and the polishing layer 102, the detection window 106 has better bonding strength in the polishing layer 102. In other words, since the bonding area and the bonding strength between the detection window 106 and the polishing layer 102 are greater, the issue of polishing slurry leakage caused by wear to the polishing pad 100 as the number of polished objects is increased can be prevented, such that the lifetime of the polishing pad 100 is increased.

In an embodiment, the thickness t2 corresponding to the region outside the protrusion 104 in the polishing layer 102 is, for instance, between 1 mm and 2 mm (i.e., 1 mm≤t2≤2 mm); the thickness t3 of the protrusion 104 protruding from the back surface 102*b* of the polishing layer 102 is, for instance, between 0.1 mm and 2 mm (i.e., 0.1 mm≤t3≤2 mm); and the thickness t1 of the detection window 106 is, for instance, between 1.1 mm and 4 mm (i.e., 1.1 mm≤t1≤4 mm). In other words, the thickness t1 of the detection window 106 is 110% to 200% of the thickness t2 corresponding to the region outside the protrusion 104 (i.e., the main polishing region) in the polishing layer 102 (i.e., 1.1≤t1/t2≤2), but the invention is not limited thereto. Comparing the embodiments above and the polishing pad 1 of prior art (shown in FIG. 1), the bonding area between the detection window 106 and the polishing layer 102 of the polishing pad 100 of the invention is increased by 10% to 100% over the conventional polishing pad 1. In other words, comparing the bonding strength between the detection window and the polishing layer in the polishing pad having the same thickness, the bonding strength of the polishing pad 100 of the invention is increased by 10% to 100% over the conventional polishing pad 1.

Moreover, to further increase the bonding area of the detection window 106 and the polishing layer 102 for enhancing the tightness between the two, the following is provided. In an embodiment, a sidewall of the detection window 106 (i.e., the surface bonded to the polishing layer 102) can be uneven, such as a concave-convex surface, spiral surface, wavy surface, stripe surface, granular surface, or a combination thereof, but the invention is not limited thereto. Moreover, the detection window 106 can be designed as various shapes according to actual requirement, such as rectangle, spindle, or elliptical, but the invention is not limited thereto. In an embodiment, the detection window 106 and the protrusion 104 can include shape's corresponding to each other according to the order of forming. In other words, the detection window 106 and the protrusion 104 can have the same shape. In another embodiment, the detection window 106 and the protrusion 104 can also have different shapes, such as the detection window 106 is spindle and the protrusion 104 is elliptical as shown in FIG. 2A, but the invention is not limited thereto. In the present embodiment, when the polymer base material of the polishing layer 102 is injected into the mold, better bonding with the spindle detection window 106 predisposed inside the mold can be achieved, and the elliptical protrusion 104 can reduce the stress concentration issue of the polishing pad 100. Moreover, when the polymer base material of the polishing layer 102 is injected into the mold, the flowing polymer base material is first separated at a front end of the detection window 106 (the end close to the material injection direction) and bonded at a back end of the detection window 106 (the end away from the material injection direction). Therefore, in an embodiment, a long-axis direction of the detection window 106 can be disposed in a radius direction of the polishing layer 102 (i.e., the long-axis of the detection window 106 virtually extends to the center of the polishing layer 102). For instance, the long-axis direction of a detection window 106 having a spindle shape can be disposed in the radius direction of the polishing layer 102. As a result, when the polymer base material of the polishing layer 102 is injected into the mold, such as injected into the mold via central injection (suitable for, for instance, the distribution of FIG. 2A, FIG. 3B, or FIG. 3D) or side injection (suitable for, for instance, the distribution of FIG. 2A, FIG. 3A, or FIG. 3C), the polymer base material can be tightly combined with the front end and the back end of the detection window 106 such that the interface of the detection window 106 and the polishing layer 102 does not contain gaps. As a result, the bonding between the detection window 106 and the polishing layer 102 is increased, and leakage of a polishing slurry between the detection window 106 and the polishing layer 102 during the polishing process can be prevented to ensure polishing stability.

Referring further to FIG. 2B, a base layer 108 is located below the polishing layer 102 in the region outside the protrusion 104. The base layer 108, suitable as a supporting layer, is positioned below the polishing layer 102 and fixed on a polishing platen (not shown). The base layer 108 generally has a greater compressibility than the polishing layer 102, and therefore, in the polishing process, the surface of the polishing pad 102 and the polished object can be evenly in contact to enhance polishing efficiency. The main material of the base layer 108 is, for instance, polyurethane, polyethylene, polypropylene, a copolymer of polyethylene and ethylene vinyl acetate, a copolymer of polypropylene and ethylene vinyl acetate, or any currently known material that can be used in the base layer of the polishing pad. As shown in FIG. 2B, the thickness of the base layer 108 is t4, and the thickness t4 is, for instance, between 1 mm and 2 mm (i.e., 1 mm≤t4≤2 mm), but the invention is not limited thereto. Moreover, a spacing d is between the base layer 108 and the detection window 106, and the spacing d is, for instance, between 1 mm and 10 mm, but the invention is not limited thereto. The sum of the thickness t4 of the base layer 108 and the thickness t2 corresponding to the region outside the protrusion 104 in the polishing layer 102 is greater than or equal to the thickness t1 of the detection window, and the thickness t1 of the detection window is greater than the thickness t2 corresponding to the region outside the protrusion 104 in the polishing layer 102 (i.e., t2+t4≥t1>t2). In an embodiment, the thickness t3 of at least one protrusion 104 in the polishing layer 102 is, for instance, between 10% and 100% of the thickness t4 of the base layer 108 (i.e., 0.1≤t3/t4≤1). Since the location of the protrusion 104 is extended between upper and lower surfaces of the base layer 108 and the bonding interface between the detection window 106 and the polishing layer 102 includes the protrusion 104, the bonding interface between the detection window 106 and the polishing layer 102 is extended between the upper and lower surfaces of the base layer 108. As a result, without increasing the thickness of the polishing pad 100, such as maintaining the same thickness as the polishing pad 1 of the prior art (for instance, the thickness of the polishing layer 2 shown in FIG. 1 is t2 and the thickness of the base layer 4 is t4), the polishing pad 100 of the invention can increase the bonding area between the detection window 106 and the polishing layer 102 (i.e., the detection window thickness, positively proportional to the bonding area, is increased from the thickness t2 to the thickness t1), such that the detection window 106 has better bonding strength in the polishing layer 102 and the optical detection quality of the detection window is improved and the lifetime of the polishing pad 100 is increased as a result.

Figure 4A:
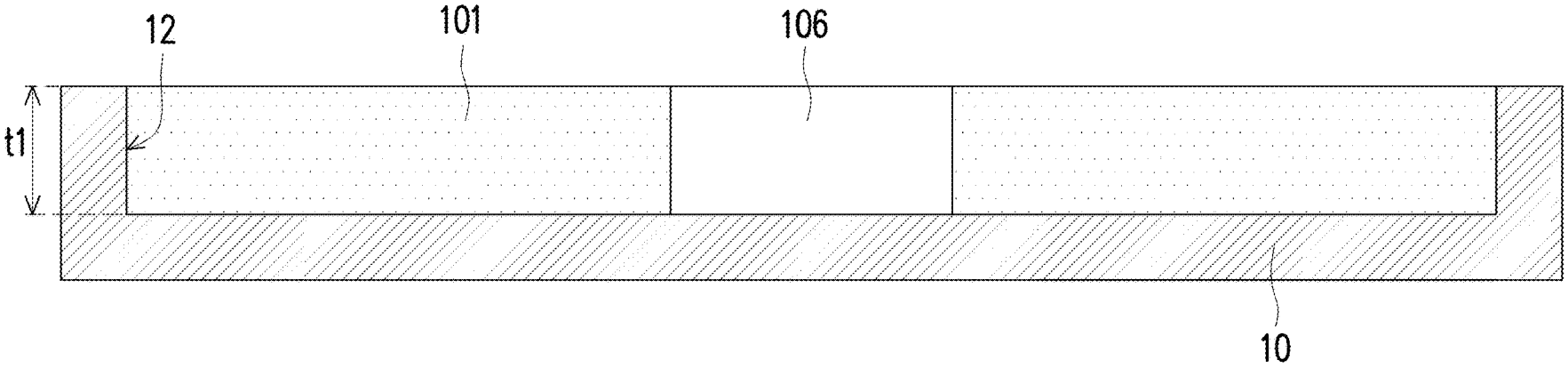
FIG. 4A to FIG. 4D are cross sections of the manufacturing method of a polishing pad of an embodiment of the invention.
Figure 4B:
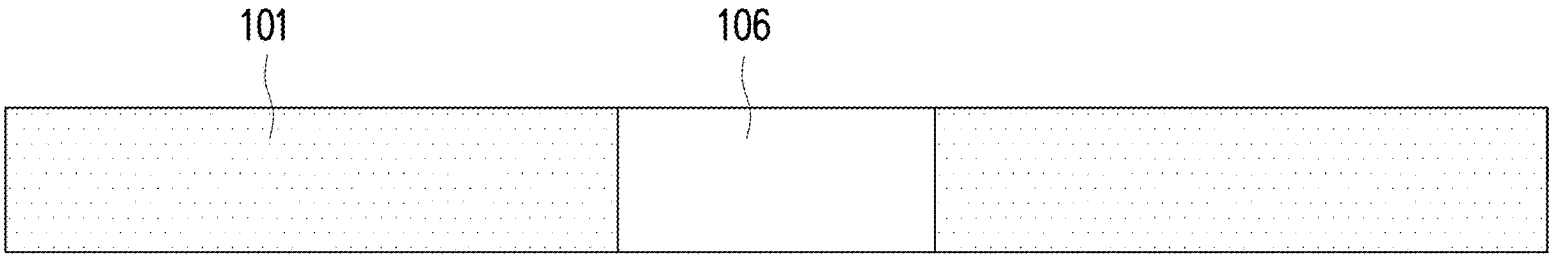
Figure 4C:
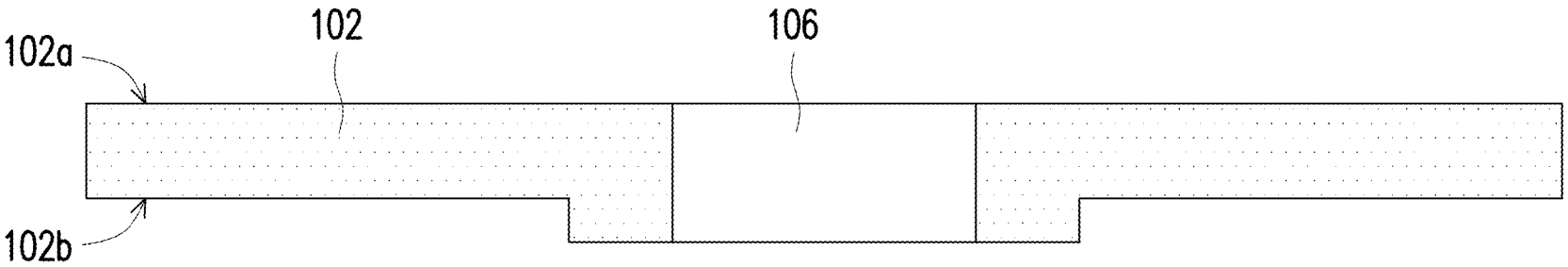

Moreover, the location at which the optical detection system is disposed on a polishing platen (i.e., the platen to which the polishing pad 100 is fixed) of some polishing equipment has a recessed region design to meet the requirements of the polishing process of different objects or optical detection quality. Therefore, as shown in FIG. 4C, the polishing pad 100 can also not contain the base layer 108. In other words, the polishing pad 100 only contains the polishing layer 102 in which the back surface has the protrusion 104 and the detection window 106. In the present embodiment, when the polishing pad 100 is fixed to the polishing platen, the protrusion 104 corresponds to the recessed region on the polishing platen on which the optical detection system is located.

Figure 3A:
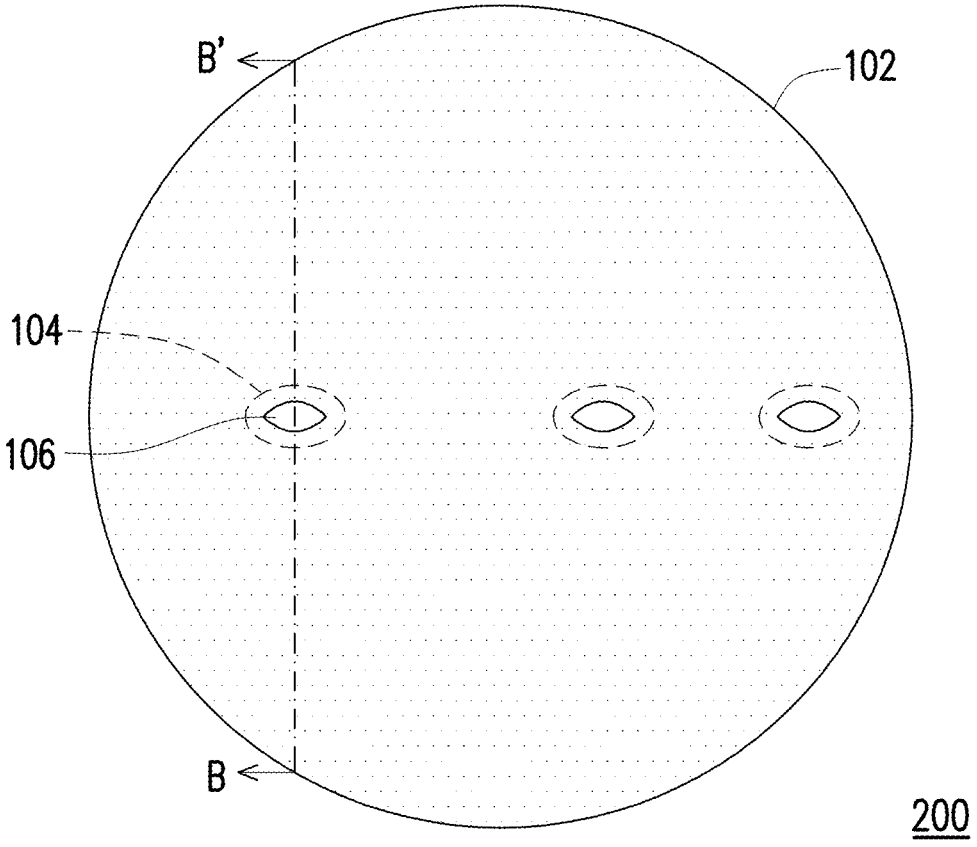
FIG. 3A is a top view of a polishing pad according to another embodiment of the invention.
Figure 3B:
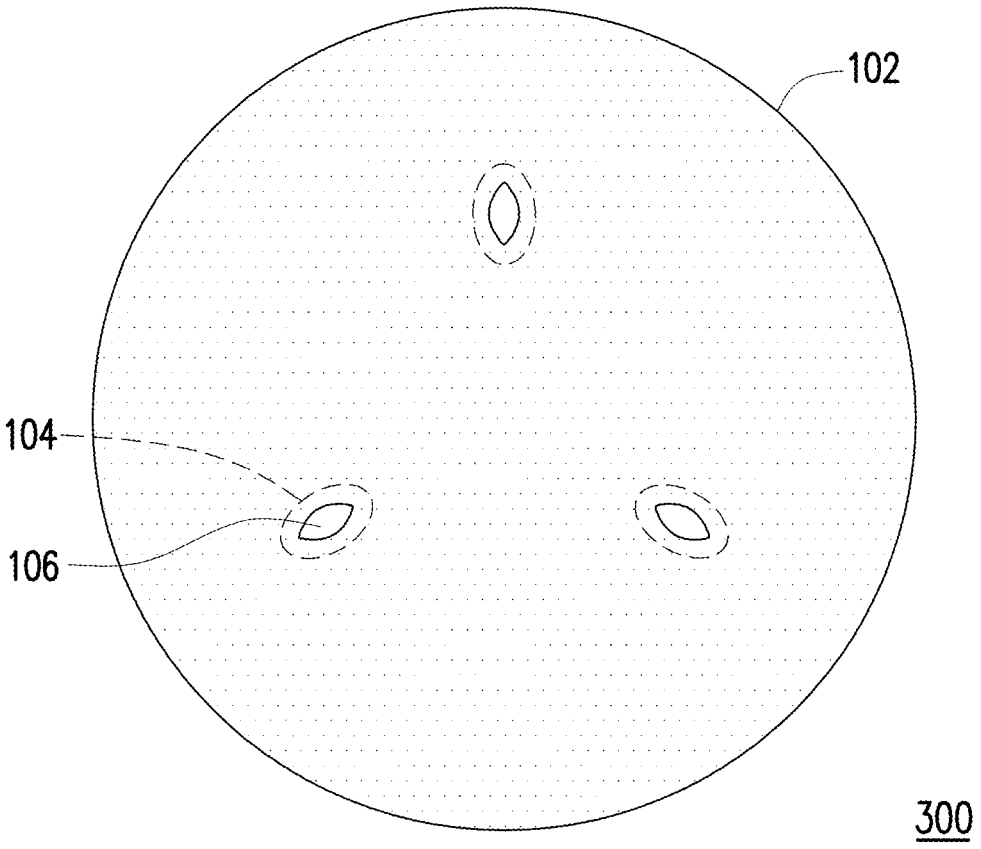
FIG. 3B is a top view of a polishing pad according to yet another embodiment of the invention.

FIG. 3A is a top view of a polishing pad according to another embodiment of the invention. FIG. 3B is a top view of a polishing pad according to yet another embodiment of the invention. The polishing pad 200 is substantially similar to the polishing pad 100, and the difference thereof is that the polishing pad 200 has a plurality of detection windows 106 and a plurality of protrusions 104, and the plurality of protrusions 104 respectively surround the plurality of detection windows 106, wherein the cross section along line B-B' of FIG. 3A has the same structural schematic as FIG. 2B. In the embodiment of FIG. 3A, the polishing pad 200 has three detection windows 106 and three protrusions 104 distributed in a strip shape along the diameter direction of the polishing layer 102 and located near different radii respectively, such as respectively located near ½ radius of the left side of the center and near ¼ radius and ¾ radius of the right side of the center, but the invention is not limited thereto. The polishing pad 200 can also include two detection windows 106 and two protrusions 104 respectively located at two sides of the center with the same radius, or include a plurality of detection windows 106 and a plurality of protrusions 104 of other quantities. In other embodiments, as shown in FIG. 3B, the plurality of detection windows 106 and the plurality of protrusions 104 of a polishing pad 300 can also be distributed in a ring shape along the circumferential direction of the polishing layer 102, wherein the cross section of one of the detection windows 106 disposed along the radius direction of the polishing pad 300 of FIG. 3B has the same structural schematic as FIG. 2B. The structural relationship, relative location, material, thickness, or efficacy of other components in the polishing pads 200 and 300 are described in detail above and are not repeated herein.

Figure 3C:
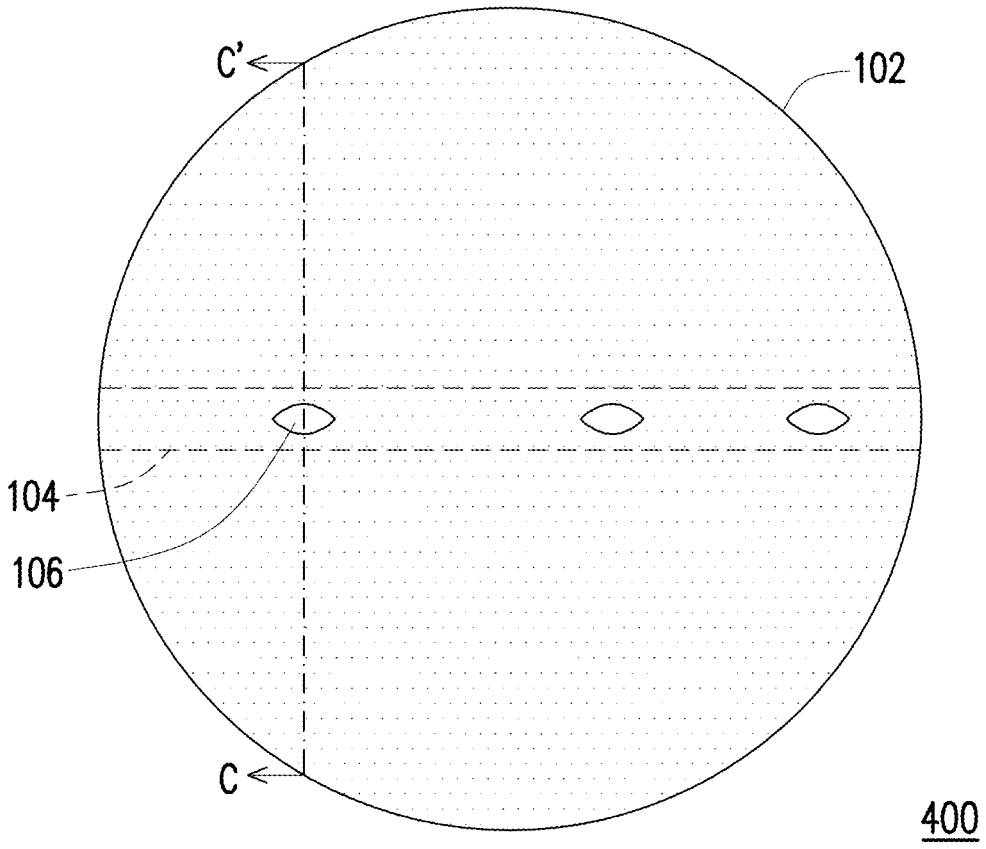
FIG. 3C is a top view of a polishing pad of still yet another embodiment of the invention.
Figure 3D:
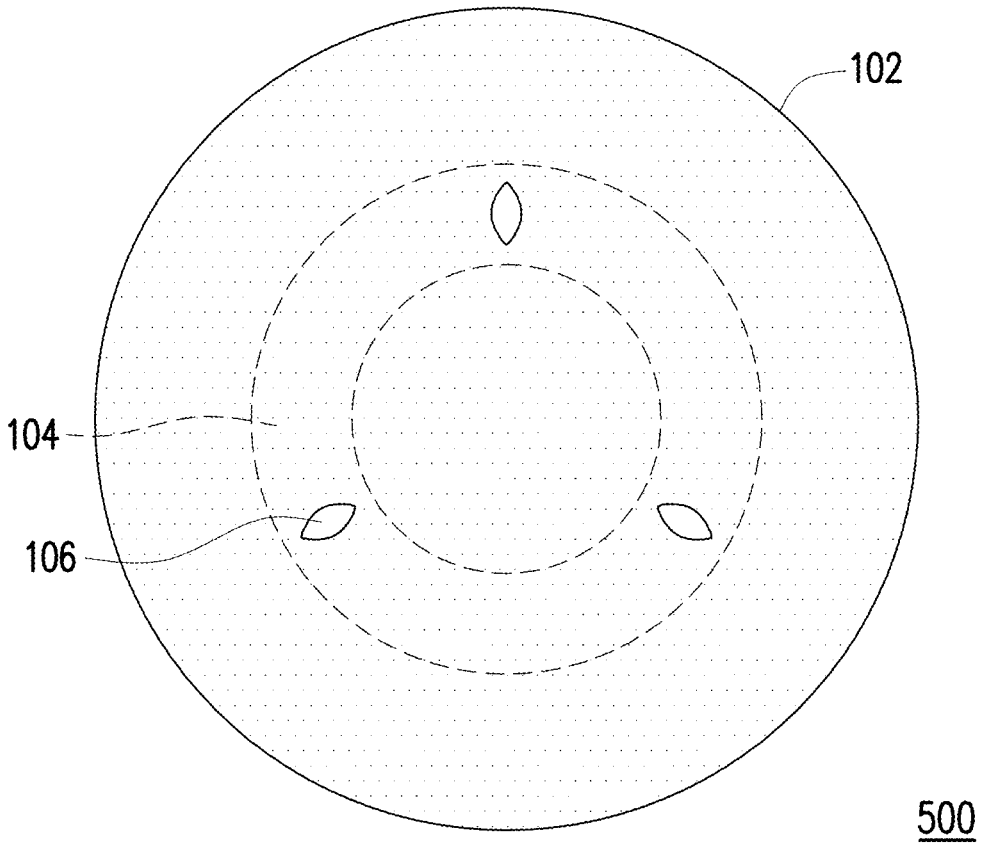
FIG. 3D is a top view of a polishing pad of still yet another embodiment of the invention.

FIG. 3C is a top view of a polishing pad according to still yet another embodiment of the invention. FIG. 3D is a top view of a polishing pad according to still yet another embodiment of the invention. A polishing pad 400 is substantially similar to the polishing pad 200, and the difference thereof is that the polishing pad 400 has a plurality of detection windows 106 and a single protrusion 104, and the single protrusion 104 surrounds the plurality of detection windows 106, wherein the cross section along line C-C' of FIG. 3C has the same structural schematic as FIG. 2B. In the embodiment shown in FIG. 3C, a single protrusion 104 in the polishing layer 102 is distributed as a strip shape along the diameter direction of the polishing layer 102, but the invention is not limited thereto. In other embodiments, as shown in FIG. 3D, the plurality of detection windows 106 and the single protrusion 104 of a polishing pad 500 can also be distributed in a ring shape along the circumferential direction of the polishing layer 102, wherein the cross section of one of the detection windows 106 disposed along the radius direction of the polishing pad 500 of FIG. 3D has the same structural schematic as FIG. 2B. The structural relationship, relative location, material, thickness, or efficacy of other components in the polishing pads 400 and 500 are described in detail above and are not repeated herein.

In the following, the manufacturing method of the polishing pad 100/200/300/400/500 of each embodiment above is further described via FIG. 4A to FIG. 4D. It should be mentioned that, although the polishing pad 100/200/300/400/500 of each embodiment above is described via the manufacturing method below as an example, the manufacturing method of the polishing pad 100/200/300/400/500 of the invention is not limited thereto, and the material, thickness, or efficacy of the same or similar components in the polishing pad 100/200/300/400/500 are described in detail above and are not repeated herein.

Figure 4D:
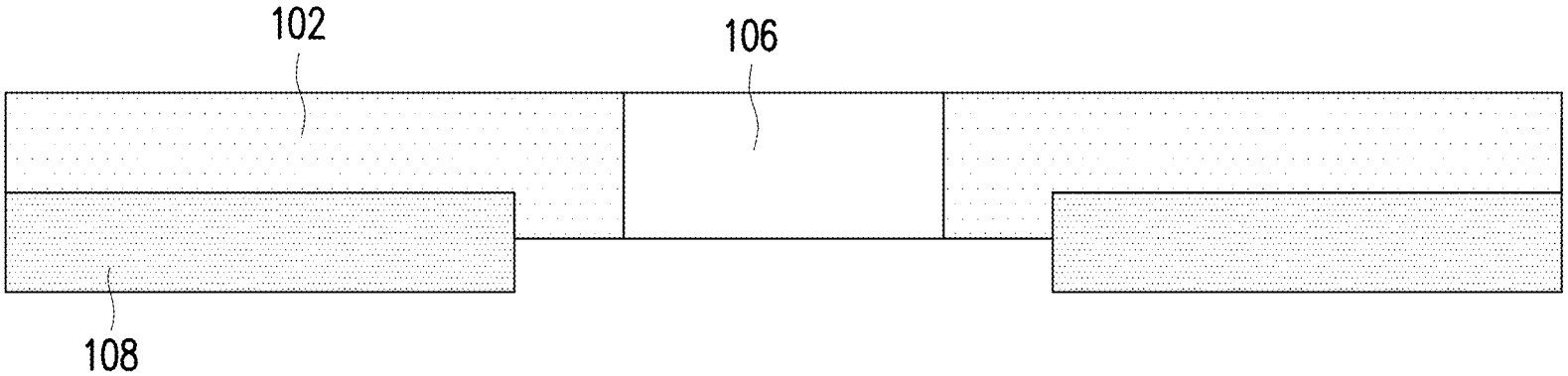
Figure 5:
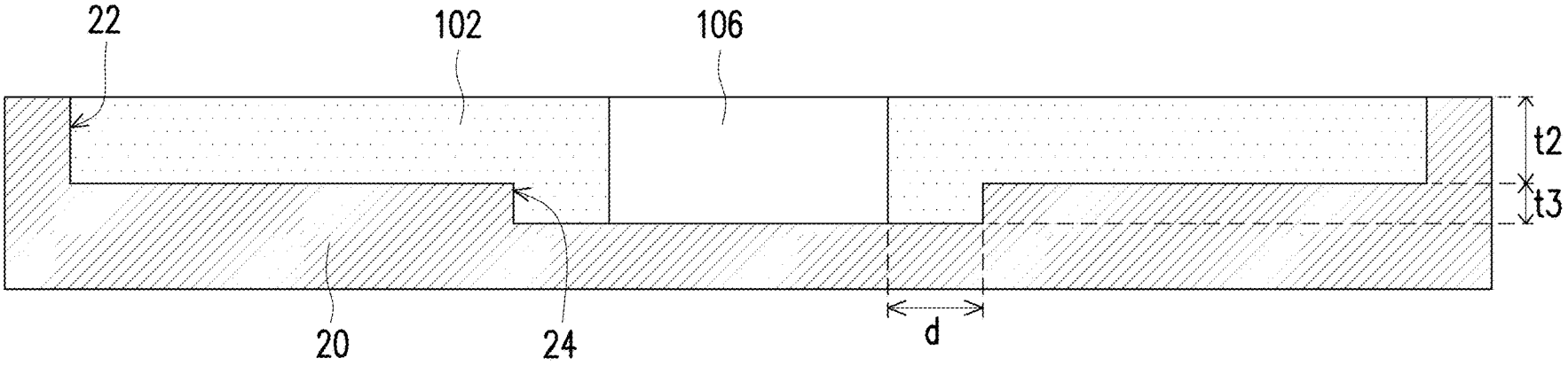
FIG. 5 is a cross section of the manufacturing method of a polishing pad of another embodiment of the invention.

FIG. 4A to FIG. 4D are cross sections of the manufacturing method of a polishing pad of an embodiment of the invention. FIG. 5 is a cross section of the manufacturing method of a polishing pad of another embodiment of the invention.

First, at least one detection window 106 is formed in a polishing material layer 101. In an embodiment, as shown in FIG. 4A, the detection window 106 is formed in the polishing material layer 101 via the method of a mold 10, and the detailed steps are as follows. A mold 10, having a mold cavity 12 for accommodating a molding material, is provided. In the present embodiment, the shape and size of the mold cavity 12 are related to the shape and size of the polishing layer 102 to be subsequently formed. Moreover, to allow those skilled in the art to clearly understand the invention, in the following figures, only a portion of the mold 10 is shown, i.e., the top cover structure of the mold 10 is omitted.

Next, a detection window 106 is disposed at a specific location inside the mold cavity 12 of the mold 10, and the specific location corresponds to the location of the optical detection system of a polishing equipment. In the present embodiment, the thickness t1 of the detection window 106 is comparable to the depth of the mold cavity 12. Moreover, the detection window 106 can be fixed to a specific location of the mold 10 by pressing (i.e., the detection window 106 is pressed and fixed between the top cover structure and the mold 10) or via an adhesive.

Next, a polishing layer material is filled in the mold 10 to form a polishing material layer 101 surrounding the detection window 106 in the mold 10. Next, a curing process is performed to cure the polishing material layer 101 such that the polishing material layer 101 and a side surface of the detection window 106 are integrally bonded to each other. The curing process includes, for instance, performing a polymerization reaction naturally reacted from the reactants of the polishing material layer 101 or performing an irradiation process or a heating process to generate a polymerization reaction such that the polishing material layer 101 is cured. Lastly, as shown in FIG. 4B, the mold 10 is removed to form at least one detection window 106 in the polishing material layer 101. In another embodiment, the structure shown in FIG. 4B can alternatively be manufactured by firstly forming a polishing material layer 101, followed by forming at least one detection window opening in the polishing material layer 101 via a mechanical process or a chemical process, and then forming the detection window 106 in the detection window opening.

Next, referring to both FIG. 4B and FIG. 4C, a portion of the polishing material layer 101 is removed to form the polishing layer 102, wherein the polishing layer 102 includes a polishing surface 102*a* and a back surface 102*b* having at least one protrusion 104, the detection window 106 is formed at a location corresponding to the protrusion 104 in the polishing layer 102, and the protrusion 104 surrounds the detection window 106. The method of removing a portion of the polishing material layer 101 includes, for instance, performing a mechanical process or chemical process on the back surface of the polishing material layer 101 (i.e., the back surface 102*b* of the polishing layer 102) to remove a portion of the polishing material layer 101 to form a polishing layer 102 in which the back surface 102*b* has a protrusion 104. Since the polishing layer 102 (in which the back surface 102*b* has a protrusion 104) and the side surface of the detection window 106 are integrally bonded to each other, the bonding area between the detection window 106 and the polishing layer 102 can be increased to enhance the bonding strength between the two.

Next, referring to FIG. 4D, a base layer 108 is formed below the polishing layer 102 in the region outside the protrusion 104. In an embodiment, for instance, a continuous base layer material is first provided, and then a portion of the base layer material corresponding to the protrusion 104 is removed to form a base layer 108, and then the base layer 108 is formed below the polishing layer 102 in the region outside the protrusion 104. Before the base layer 108 is formed, a first adhesive layer (not shown) can be optionally formed between the polishing layer 102 in the region outside the protrusion 104 and the base layer 108 to fix the base layer 108 below the polishing layer 102 in the region outside the protrusion 104. The first adhesive includes, for instance (but is not limited to): carrier-free adhesive, double-sided adhesive, UV-cured adhesive, hot melt adhesive, moisture-curing adhesive, or pressure-sensitive adhesive (PSA). The material of the adhesive layer is, for instance, acrylic adhesive, epoxy resin adhesive, or polyurethane adhesive, but the invention is not limited thereto. Moreover, a second adhesive layer (not shown) can be optionally formed below the base layer 108, and the polishing pad 100/200/300/400/500 can be fixed on a polishing platen (not shown) via adhesion of the second adhesive layer. The second adhesive layer includes (but is not limited to), for instance, carrier-free adhesive, double-sided adhesive, or pressure-sensitive adhesive. The material of the adhesive layer is, for instance, acrylic adhesive, epoxy resin adhesive, or polyurethane adhesive, but the invention is not limited thereto. In other embodiments, the base layer 108 can be formed below the polishing layer 102 in the region outside the protrusion 104, via a coating, spray coating, stacking, or printing method instead, without the use of the first adhesive layer. Therefore, the process of removing a portion of the base layer material is not required. Moreover, the polishing pad 100/200/300/400/500 can be fixed on the polishing platen, via vacuum adsorption or electrostatic adsorption method instead, without the use of the second adhesive layer.

In another embodiment, as the following, the manufacturing method of the polishing pad 100/200/300/400/500 is described via FIG. 5, wherein a mold 20 is substantially similar to the mold 10 of FIG. 4A, and the difference therebetween is that the mold cavity 22 of the mold 20 includes at least one recessed portion 24. The material, thickness, or efficacy of the same or similar components in the polishing pad 100/200/300/400/500 or the mold 20 are described in detail above and are not repeated herein. Moreover, to allow those skilled in the art to clearly understand the invention, in the following figures, only a portion of the mold 20 is shown, i.e., the top cover structure of the mold 20 is omitted.

Referring to FIG. 5, a mold 20 is provided. The mold 20 has a mold cavity 22, and the mold cavity 22 includes a recessed portion 24, the depth of the mold cavity in the region outside the recessed portion 24 is t2, and the depth of the recessed portion 24 itself is t3. Next, the detection window 106 is disposed at a location corresponding to the recessed portion 24 in the mold cavity 22 such that the recessed portion 24 surrounds the detection window 106, and a spacing d between a side surface of the recessed portion 24 and the detection window 106 is, for instance, between 1 mm and 10 mm. The shape and size of the mold cavity 22 in the mold 20 correspond to the shape and size of the polishing layer 102 subsequently formed. In the present embodiment, the thickness t1 of the detection window 106 is comparable to the distance from the bottom portion of the recessed portion 24 in the mold cavity 22 to the top cover of the mold 20 (i.e., t2+t3). Moreover, the detection window 106 can be fixed inside the recessed portion 24 of the mold cavity 22 by pressing (i.e., the detection window 106 is pressed and fixed between the top cover structure and the mold 20) or via an adhesive.

Next, the polishing layer material is filled in the mold cavity 22 to form the polishing layer 102, wherein the polishing layer 102 includes a polishing surface 102*a* and a back surface 102*b* having at least one protrusion 104 (formed at a location of the recessed portion 24 of the mold cavity 22), wherein the detection window 106 is disposed at a location corresponding to the protrusion 104 in the polishing layer 102, and the protrusion 104 surrounds the detection window 106. As a result, the detection window 106 can be formed at a location corresponding to the protrusion 104 in the polishing layer 102 without the step of removing a portion of the polishing material layer 101 (as shown in FIG. 4C) such that the protrusion 104 surrounds the detection window 106. Therefore, in the present embodiment, the process of the polishing pad 100/200/300/400/500 can be simplified to reduce the manufacturing cost of the polishing pad 100/200/300/400/500.

Next, the mold 20 is removed to form the polishing layer 102 shown in FIG. 4C, wherein the detection window 106 thereof is formed at a location corresponding to the protrusion 104 in the polishing layer 102, and the protrusion 104 surrounds the detection window 106. Lastly, the process shown in FIG. 4D is performed to form the base layer 108 below the polishing layer 102 in the region outside the protrusion 104.

Moreover, according to the polishing method provided in the invention, the polishing pad disclosed in the invention is applied in a polishing process to polish an object. First, a polishing pad 100/200/300/400/500 is provided. The polishing pad 100/200/300/400/500 includes the polishing layer 102 and at least one detection window 106. The polishing layer 102 includes a polishing surface 102*a* and a back surface 102*b* having at least one protrusion 104. The detection window 106 is disposed at a location corresponding to the protrusion 104 in the polishing layer 102, and the protrusion 104 surrounds the detection window 106. Next, a pressure is applied to an object (not shown) to hold the object on the polishing pad 100/200/300/400/500 such that the object and the polishing surface 102*a* of the polishing pad 100/200/300/400/500 are in contact. Next, a relative motion is applied between the object and the polishing pad 100/200/300/400/500 to polish the object using the polishing pad 100/200/300/400/500 to achieve the object of planarization. Relevant descriptions of the polishing pad 100/200/300/400/500 are provided in the embodiments above and are not repeated herein.

The polishing pad 100/200/300/400/500 in each embodiment above can be applied to various polishing equipment and polishing process for manufacturing devices such as semiconductors, integrated circuits, micro electro-mechanicals, energy conversion, communication, optics, storage discs, or displays. The polished objects used in the manufacture of the devices can include, for instance, semiconductor wafers, Group III-V wafer, storage device carriers, ceramic substrates, polymer substrates, or glass substrates, but the scope of the invention is not limited thereto.

Based on the above, in the polishing pad and the manufacturing method thereof provided in the embodiments, since the detection window is disposed at a location corresponding to the protrusion in the polishing layer and the protrusion surrounds the detection window, the bonding area between the detection window and the polishing layer can be increased such that the bonding strength of the detection window is better in the polishing layer and the lifetime of the polishing pad is increased as a result.

Although the invention has been described with reference to the above embodiments, it will be apparent to one of ordinary skill in the art that modifications to the described embodiments may be made without departing from the spirit of the invention. In view of the foregoing, it is intended that the present invention cover modifications and variations of this invention provided they fall within the scope of the following claims and their equivalents.

What is claimed is:

1. A polishing pad, comprising:

a polishing layer comprising a polishing surface and a back surface having at least one protrusion; and at least one detection window disposed at a location corresponding to the at least one protrusion in the polishing layer, wherein the at least one protrusion surrounds the at least one detection window, wherein a material of the at least one detection window is transparent polymer, a top surface of the at least one detection window and the polishing surface of the polishing layer are coplanar, and a bottom surface of the at least one detection window and a bottom surface of the protrusion are coplanar;

wherein a thickness of the detection window is t1, a thickness corresponding to a region outside the at least one protrusion in the polishing layer is t2, a thickness of the at least one protrusion is t3, and t1=t2+t3.

2. The polishing pad of claim 1, wherein the polishing layer and a side surface of the at least one detection window are integrally bonded to each other.

3. The polishing pad of claim 1, wherein the at least one detection window includes a plurality of detection windows, the at least one protrusion includes a plurality of protrusions, and the plurality of protrusions respectively surround the plurality of detection windows.

4. The polishing pad of claim 1, wherein the at least one detection window includes a plurality of detection windows, the at least one protrusion is a single protrusion, and the single protrusion surrounds the plurality of detection windows.

5. The polishing pad of claim 4, wherein the single protrusion is distributed in a strip shape along a diameter direction of the polishing layer or distributed in a ring shape along a circumferential direction of the polishing layer.

6. The polishing pad of claim 1, wherein t1 is between 110% and 200% of t2.

7. The polishing pad of claim 1, wherein the at least one detection window and the at least one protrusion have a same shape.

8. The polishing pad of claim 1, wherein a shape of the at least one detection window is spindle, and a shape of the at least one protrusion is elliptical.

9. The polishing pad of claim 1, wherein a long-axis direction of the at least one detection window is disposed in a radius direction of the polishing layer.

10. The polishing pad of claim 1, further comprising: a base layer located below the polishing layer in a region outside the at least one protrusion.

11. The polishing pad of claim 10, wherein a spacing d is between the base layer and the at least one detection window, and d is between 1 mm and 10 mm.

12. The polishing pad of claim 10, wherein a thickness of the base layer is t4, and t2+t4>t1>t2.

13. The polishing pad of claim 10, wherein a thickness of the base layer is t4, and t3 is between 10% and 100% of t4.

14. The polishing pad of claim 10, wherein a bonding interface between the detection window and the polishing layer is extended between an upper surface and a lower surface of the base layer.

15. A manufacturing method of a polishing pad, comprising: forming at least one detection window in a polishing material layer; and removing a portion of the polishing material layer to form a polishing layer, wherein the polishing layer comprises a polishing surface and a back surface having at least one protrusion, the detection window is disposed at a location corresponding to the at least one protrusion in the polishing layer, and the at least one protrusion surrounds the at least one detection window, wherein a material of the at least one detection window is transparent polymer, a top surface of the at least one detection window and the polishing surface of the polishing layer are coplanar, and a bottom surface of the at least one detection window and a bottom surface of the protrusion are coplanar; wherein a thickness of the detection window is t1, a thickness corresponding to a region outside the at least one protrusion in the polishing layer is t2, a thickness of the at least one protrusion is t3, and t1=t2+t3.

16. The manufacturing method of the polishing pad of claim 15, wherein the polishing layer and a side surface of the at least one detection window are integrally bonded to each other.

17. The manufacturing method of the polishing pad of claim 15, wherein the at least one detection window includes a plurality of detection windows, the at least one protrusion includes a plurality of protrusions, and the plurality of protrusions respectively surround the plurality of detection windows.

18. The manufacturing method of the polishing pad of claim 15, wherein the at least one detection window includes a plurality of detection windows, the at least one protrusion is a single protrusion, and the single protrusion surrounds the plurality of detection windows.

19. The manufacturing method of the polishing pad of claim 18, wherein the single protrusion is distributed in a strip shape along a diameter direction of the polishing layer or distributed in a ring shape along a circumferential direction of the polishing layer.

20. The manufacturing method of the polishing pad of claim 15, further comprising:

forming a base layer below the polishing layer in a region outside the at least one protrusion.

21. The manufacturing method of the polishing pad of claim 20, wherein a spacing d is between the base layer and the at least one detection window, and d is between 1 mm and 10 mm.

22. The manufacturing method of the polishing pad of claim 15, wherein a method of forming the at least one detection window in the polishing material layer comprises: forming at least one detection window opening in the polishing material layer; and forming the at least one detection window in the at least one detection window opening.

23. A polishing method suitable for polishing an object, the polishing method comprising: providing the polishing pad of claims 1; applying a pressure to the object to press the object on the polishing pad; and applying a relative motion between the object and the polishing pad.

* * * * *